US008083003B2

(12) United States Patent
Felten et al.

(10) Patent No.: US 8,083,003 B2
(45) Date of Patent: Dec. 27, 2011

(54) FIRE EXTINGUISHER WITH A CONTAINER HOLDING A FIRE EXTINGUISHING SUBSTANCE AND CORRESPONDING COMPRESSED-GAS CYLINDER

(75) Inventors: Frank Felten, Zemmer (DE); Karl Bermes, Irrel (DE)

(73) Assignee: Luxembourg Patent Company S.A., Luxembourg (LU)

( * ) Notice: Subject to any disclaimer, the term of this patent is extended or adjusted under 35 U.S.C. 154(b) by 491 days.

(21) Appl. No.: 12/159,880

(22) PCT Filed: Dec. 12, 2006 (Under 37 CFR 1.47)

(86) PCT No.: PCT/EP2006/070259
§ 371 (c)(1), (2), (4) Date: Mar. 23, 2009

(87) PCT Pub. No.: WO2007/077195
PCT Pub. Date: Jul. 12, 2007

(65) Prior Publication Data
US 2010/0116515 A1 May 13, 2010

(30) Foreign Application Priority Data
Jan. 2, 2006 (EP) ..... 061000139

(51) Int. Cl.
*A62C 13/00* (2006.01)

(52) U.S. Cl. ..... 169/73; 169/9; 169/26; 169/33; 169/71; 169/77; 169/85; 169/89; 239/322; 222/389

(58) Field of Classification Search ..... 169/5, 9, 169/16, 26, 30, 33, 71–73, 77, 85, 89; 239/320, 239/322, 329, 331, 569; 222/386, 389
See application file for complete search history.

(56) References Cited

U.S. PATENT DOCUMENTS
2,960,369 A * 11/1960 Goldie ..... 169/9
(Continued)

FOREIGN PATENT DOCUMENTS
BE 866485 8/1978
(Continued)

OTHER PUBLICATIONS
International Search Report PCT/EP2006/070259 Dated Apr. 16, 2007.

*Primary Examiner* — Steven J Ganey
(74) *Attorney, Agent, or Firm* — Cantor Colburn LLP

(57) ABSTRACT

A fire extinguisher (50, 50', 50') comprises a container (10, 10') that holds a fire-extinguishing substance and that has a container jacket (12, 12') closed at both ends, and a piston (20, 20') which is axially displaceable in the container jacket and which separates a space (22, 22') for fire-extinguishing substance from an expansion space (24, 24') in the container. According to the invention, an inner compressed-gas chamber (26, 26') provided in the container (10, 10') is spatially separate from the expansion space and serves for controlled pressurizing of the expansion space (24, 24'). The piston (20, 20') is arranged such that it can be displaced along the compressed-gas chamber (26, 26').

24 Claims, 8 Drawing Sheets

U.S. PATENT DOCUMENTS 3,773,111 A * 11/1973 Dunn ..... 169/26
4,889,189 A 12/1989 Rozniecki et al.
5,660,236 A * 8/1997 Sears et al. ..... 169/33
5,845,716 A * 12/1998 Birk ..... 169/85
5,984,016 A * 11/1999 Samuelsson ..... 169/73
6,047,777 A * 4/2000 Eisenbeiss et al. ..... 169/28
6,371,213 B1 4/2002 Smith et al.
7,325,622 B2 * 2/2008 Sjostrom ..... 169/33
2005/0173132 A1 8/2005 Sjostrom

FOREIGN PATENT DOCUMENTS

WO 9636398 11/1996

* cited by examiner

FIRE EXTINGUISHER WITH A CONTAINER HOLDING A FIRE EXTINGUISHING SUBSTANCE AND CORRESPONDING COMPRESSED-GAS CYLINDER

TECHNICAL FIELD OF THE INVENTION

The present invention relates to a fire-extinguishing device with a container holding a fire-extinguishing substance and a compressed gas cylinder which is particularly suitable for use together with this fire-extinguishing substance container.

BRIEF DESCRIPTION OF RELATED ART

A large number of fire-extinguishing devices of the most widely varied types with fire-extinguishing substance containers are known. In principle, a distinction may be drawn between portable fire-extinguishing devices and stationary or mobile fire-extinguishing devices. The former are particularly suitable for manual use, whereas the latter are often used in automatic fire-extinguishing systems or fire trolleys.

Many fire-extinguishing devices, in particular portable ones, have the disadvantage that they cannot be used reliably in any desired spatial orientation, i.e. the fire-extinguishing substance cannot be fully discharged in any orientation.

This problem may be avoided if a solid piston or a flexible membrane is arranged movably in the fire-extinguishing substance container and separates a fire-extinguishing substance compartment from a propellant compartment, which serves at the same time as an expansion compartment.

Such fire-extinguishing substance containers are known in particular in connection with automatic fire-extinguishing systems. These have the particular advantage over the above-described fire-extinguishing devices that complete expulsion of the fire-extinguishing substance is ensured with any desired spatial orientation of the fire-extinguishing substance container. They are therefore already used in automatic fire-extinguishing systems installed fixedly in vehicles, where an accident could lead to any orientation of the fire-extinguishing substance container.

A fire-extinguishing substance container with piston is described in WO 96/36398. This is particularly suitable for enclosed spaces, for example passenger compartments or engine compartments, and comprises a fire-extinguishing substance container with a cylindrical container shell closed at both ends and a piston axially displaceable in the container shell. In the fire-extinguishing substance container the piston separates a fire-extinguishing substance compartment, which contains a fire-extinguishing substance, from a propellant compartment, which contains a pressurized propellant gas.

The fire-extinguishing substance compartment is provided with a trip valve at an outlet for the fire-extinguishing substance. In the event of activation of the trip valve, the propellant gas may propel fire-extinguishing substance out of the fire-extinguishing substance container by displacing the piston into the fire-extinguishing substance compartment.

However, a fire-extinguishing device with a fire-extinguishing substance container according to WO 96/36398 has the particular disadvantage that the pressure of the fire-extinguishing substance is not constant during discharge thereof. To ensure complete discharge, the volume of the propellant gas has to be expanded considerably. However, this entails a severe drop in the pressure of the propellant gas and consequently also of the fire-extinguishing substance during expulsion of the fire-extinguishing substance (with no change in temperature). This means that the throughput of fire-extinguishing substance falls over the fire-extinguishing process.

Furthermore, as discharge proceeds, the fire-extinguishing substance pressure becomes less well matched to conventionally connected atomizing nozzles for the fire-extinguishing substance of such a system.

U.S. Pat. No. 4,889,189 describes the design of a fire-extinguishing substance container with an internal, expandable membrane which separates the fire-extinguishing substance compartment from the propellant compartment. Furthermore, a method is described for selecting an optimum quantity of fire-extinguishing substance and a most suitable propellant pressure. The design and the method according to U.S. Pat. No. 4,889,189 are directed, inter alia, towards reducing the above-stated disadvantageous pressure drop. However, the drop in fire-extinguishing substance pressure and fire-extinguishing substance throughput during the extinguishing process cannot be prevented satisfactorily either with this fire-extinguishing substance container or with this method.

A further design-dependent problem of known fire-extinguishing substance containers with piston or membrane is caused by the fact that both propellant and fire-extinguishing substance are permanently under nominal pressure over the service life of the fire-extinguishing device (conventionally of the order of magnitude of 100 bar or more). This increases the leakage risk of both substances, so reducing the reliability of the fire-extinguishing device.

Furthermore, the design of the fire-extinguishing substance container and connected fittings is subject to relatively stringent requirements.

BRIEF SUMMARY OF THE INVENTION

The invention proposes a fire-extinguishing device which is functional in any desired spatial orientation and ensures increased reliability.

The invention provides a fire-extinguishing device comprising a fire-extinguishing substance container with a container shell closed at both ends and a piston displaceable axially in the container shell, which piston separates a fire-extinguishing substance compartment from an expansion compartment in the fire-extinguishing substance container. According to the invention, an internal compressed gas reservoir is provided in the fire-extinguishing substance container. The compressed gas reservoir forms a compressed gas chamber separated spatially from the expansion compartment. The compressed gas chamber serves to store a propellant gas under high storage pressure and for controlled pressurization of the expansion compartment with reduced extinguishing pressure. The piston is arranged to be displaceable along the compressed gas chamber.

The compressed gas chamber according to the invention, incorporated into the container by the compressed gas reservoir, is independent of the expansion compartment, and thus also of the variable volume of the expansion compartment serving to accommodate the propellant. In this way it is possible on the one hand to use suitable switching means to prevent the expansion compartment and the fire-extinguishing substance from being under operating pressure when non-operative, while on the other hand this arrangement makes it possible, using suitable pressure control means, to achieve controlled pressurization of the expansion compartment, in particular with a relatively constant low pressure over the entire duration of fire-extinguishing substance discharge. With the design according to the invention, the propellant pressure in the expansion compartment and consequently also the fire-extinguishing (substance) pressure is not only substantially constant over the duration of fire-extinguishing substance discharge but is also freely selectable as regards absolute value and thus adaptable to various applications. Furthermore, a compact, space-saving construction of the fire-extinguishing device is obtained, which combines fire-extinguishing substance container and pressure medium source in one unit. In this way, this fire-extinguishing device is of particularly interest for use in vehicles for transporting goods and people. A complex line arrangement, as arises when separate, external pressure reservoirs are used as the pressure medium source, is very largely dispensed with, so resulting in increased safety and reliability as well as a reduction in costs.

In a construction of advantageous design, the container shell is cylindrical and the compressed gas chamber is arranged coaxially to the container shell in the fire-extinguishing substance container. An annular piston suitable for a coaxial compressed gas chamber has a circular-cylindrical external shape, for example, and is provided with a coaxial circular-cylindrical guide opening.

In a first possible configuration, a compressed gas cylinder located inside the fire-extinguishing substance container and having an at least partially cylindrical outer wall is provided as the compressed gas reservoir. The piston is designed as an annular piston and guided displaceably along the cylindrical part of the outer wall of the compressed gas cylinder. In this configuration, the compressed gas chamber is formed of a, preferably specially machined, compressed gas cylinder, such that the piston may be mounted displaceably on the cylinder itself, so saving on an additional guide.

In a second possible configuration, the fire-extinguishing device comprises a cylindrical guide shell located inside the fire-extinguishing substance container and a compressed gas cylinder, which is arranged within the cylindrical guide shell, is provided as the compressed gas reservoir. The piston is here designed as an annular piston and guided displaceably along the cylindrical guide shell. The essential difference from the first configuration consists in the fact that a conventional compressed gas cylinder may be used as a compressed gas reservoir, i.e. to provide the compressed gas chamber, and may be incorporated into the fire-extinguishing substance container. However this requires the use of a separate guide for the piston.

Furthermore, a switching valve is preferably provided for controlled pressurization of the expansion compartment, which valve is connected on the inlet side to the compressed gas chamber and on the outlet side to the expansion compartment, in order to supply the expansion compartment with compressed gas by opening the switching valve. In addition to the switching valve, the fire-extinguishing device advantageously also comprises a pressure control valve for controlled pressurization of the expansion compartment, which latter valve is connected to the inlet or outlet of the switching valve, in order to pressurize the expansion compartment with compressed gas at a predetermined, substantially constant pressure during the extinguishing process. To control the switching valve, a preferred configuration provides that the switching valve comprises at least one pneumatic control port, and a temperature-sensitive, pressurized detector line is present, which is connected to the pneumatic control port of the switching valve in order to open the switching valve in the event of a pressure drop in the detector line. This makes possible simple and reliable automatic triggering of the fire-extinguishing device if necessary.

In one possible configuration, the fire-extinguishing device comprises a switching valve with a first and a second pneumatic control port, a first pressure control valve, and a port for a detector line, the first pressure control valve being connected on the inlet side directly to the compressed gas chamber and on the outlet side to the inlet of the switching valve, the port for the detector line being connected to the first control port and the outlet of the first pressure control valve being additionally connected to the second control port, and the switching valve being connected on the outlet side to the expansion compartment. This configuration is particularly suitable for expulsion of fire-extinguishing substance under a moderate pressure, which matches that in the detector line.

In a further possible configuration, the fire-extinguishing device additionally comprises a second pressure control valve, which is connected on the inlet side to the outlet of the first pressure control valve and on the outlet side to the inlet of the switching valve or on the inlet side to the outlet of the switching valve and on the outlet side to the expansion compartment. This configuration Is particularly suitable for expelling fire-extinguishing substance at a low pressure, which is lower than that in the detector line.

In another possible configuration the fire-extinguishing device additionally comprises a second pressure control valve, which is connected on the inlet side to the first control port and on the outlet side to the port for the detector line. This configuration is particularly suitable for expelling fire-extinguishing substance at a high pressure, which is higher than that in the detector line.

Preferably, the fire-extinguishing device further comprises an equalizing line for compensating leaks in the detector line, this being connected to the outlet of the first pressure control valve and to the port for the detector line, a non-return valve being arranged in the equalizing line and preventing an excessive loss of propellant via the equalizing line in the event of a significant pressure loss in the detector line.

Preferably, the fire-extinguishing device further comprises a creeping gas safety device, which is connected to the outlet of the switching valve to prevent a creeping pressure build-up in the expansion compartment.

In a particularly compact and robust construction, the fire-extinguishing device further comprises a compressed gas cylinder located inside the fire-extinguishing substance container, the compressed gas cylinder comprising the pressure chamber and a thickened cylinder bottom, which in the form of a fittings block accommodates at least the switching valve, the first pressure control valve and, if applicable, the second pressure control valve. In this case, it is advantageous for the connecting line, which leads via the switching valve, the first pressure control valve and optionally the second pressure control valve from the pressure chamber to the expansion compartment, to be formed by bores in the fittings block. In this construction, the fire-extinguishing device is even more compact, leakproof, and robust.

When a compressed gas cylinder is used which is located inside the fire-extinguishing substance container, sizing in which the compressed gas cylinder occupies 10% to 35% of the useful volume of the fire-extinguishing substance container has proven to be preferable.

In contrast to the prior art, the configuration of the fire-extinguishing substance container proposed herein makes it possible for the fire-extinguishing substance container to be designed for a relatively low (extinguishing) pressure of for example <90 bar although the propellant gas is stored at a substantially higher storage pressure of for example >150 bar in the separate compressed gas reservoir.

In order to accommodate the largest possible volume of fire-extinguishing substance in the container, it is advantageous for the piston to comprise an inner guide bush for guidance against the cylindrical part of the compressed gas cylinder or against the guide shell and an outer guide skirt for guidance against the container shell, the guide bush extending less far axially than the guide skirt. In this way, the piston may be acted upon by propellant from the middle of the container even when in the end position.

The piston is preferably guided against the compressed gas chamber by means of an opening corresponding to the cross-section of the latter, such that it surrounds the compressed gas chamber. It is likewise possible to arrange piston and compressed gas chamber with complementary cross sections in the container shell in such a way that the piston does not surround the compressed gas chamber.

The present invention also relates, independently of the fire-extinguishing device, to a specially developed compressed gas cylinder and in particular to the production method therefore. Without limitation to this application, the use of such a special compressed gas cylinder is particularly advantageous in the fire-extinguishing device according to the invention.

A production method according to the invention for such a compressed gas cylinder comprises the following steps:

indirect extrusion of a blank to produce a formed article which comprises a cylinder bottom and a cylindrical cylinder shell, the cylinder shell being closed at one end by the cylinder bottom;

processing the formed article to produce a compressed gas cylinder blank by shaping the cylindrical cylinder shell into a cylinder neck in the opposite end region to the cylinder bottom;

processing the compressed gas cylinder blank to produce a compressed gas cylinder.

According to the invention, the production method is characterized in that the indirect extrusion is carried out in that the cylinder bottom takes the form of a solid, thickened base plate and the processing of the compressed gas cylinder blank to produce a compressed gas cylinder comprises at least the formation of a receiving bore for a valve in the solid, thickened base plate.

In the method, the solid, thickened base plate preferably takes the form of a cylindrical solid body, which, after indirect extrusion, has the same radius as that of the cylindrical cylinder shell.

Processing of the compressed gas cylinder blank to produce a compressed gas cylinder preferably includes the formation of at least one housing and valve seat bore as a receiving bore for a valve.

For connection of the valve(s) to be incorporated into the cylinder bottom, processing of the compressed gas cylinder blank to produce a compressed gas cylinder advantageously includes the formation of at least one connecting bore from the receiving bore to the interior of the compressed gas cylinder and at least one outlet bore from the receiving bore to the outside in the thickened, solid base plate.

To allow full installation of the necessary fittings, in the method the indirect extrusion is advantageously performed in such a way that the base plate extends in the longitudinal direction of the compressed gas cylinder by 5 to 15 times the wall thickness of the cylinder shell or at least 50 mm.

To produce a compressed gas cylinder In particular for more complex applications, the processing of the compressed gas cylinder blank to produce a compressed gas cylinder additionally preferably includes the following steps:

forming a plurality of housing and valve seat bores, at least one connecting bore from a first housing and valve seat bore to the interior of the compressed gas cylinder and at least one connecting bore from a further housing and valve seat bore to the outside, all the housing and valve seat bores being arranged in the thickened, solid base plate; and forming at least one connecting bore between the first housing and valve seat bore and a further housing and valve seat bore, the connecting bore extending in the thickened, solid base plate obliquely relative to the longitudinal axis of the compressed gas cylinder.

In this way, all the necessary machining steps for the fittings block may be performed from the end face of the cylinder bottom. Rechucking of the workpiece is unnecessary. It is made simply possible to incorporate the connecting lines between the fittings into the cylinder bottom designed as a fittings block.

If it is intended to utilize the compressed gas cylinder as a guide for a piston in a fire-extinguishing substance container according to the invention, the processing of the compressed gas cylinder blank to produce a compressed gas cylinder preferably additionally includes machining the outer surface of the cylinder shell as a cylindrical guide by material-removing shaping.

BRIEF DESCRIPTION OF THE DRAWINGS

A number of configurations of the invention will now be described in greater detail below with reference to the attached, illustrative Figures. In the Figures identical or primed reference signs are used throughout for identical or similar components. In the drawings.

DETAILED DESCRIPTION OF THE INVENTION

Figure 1:
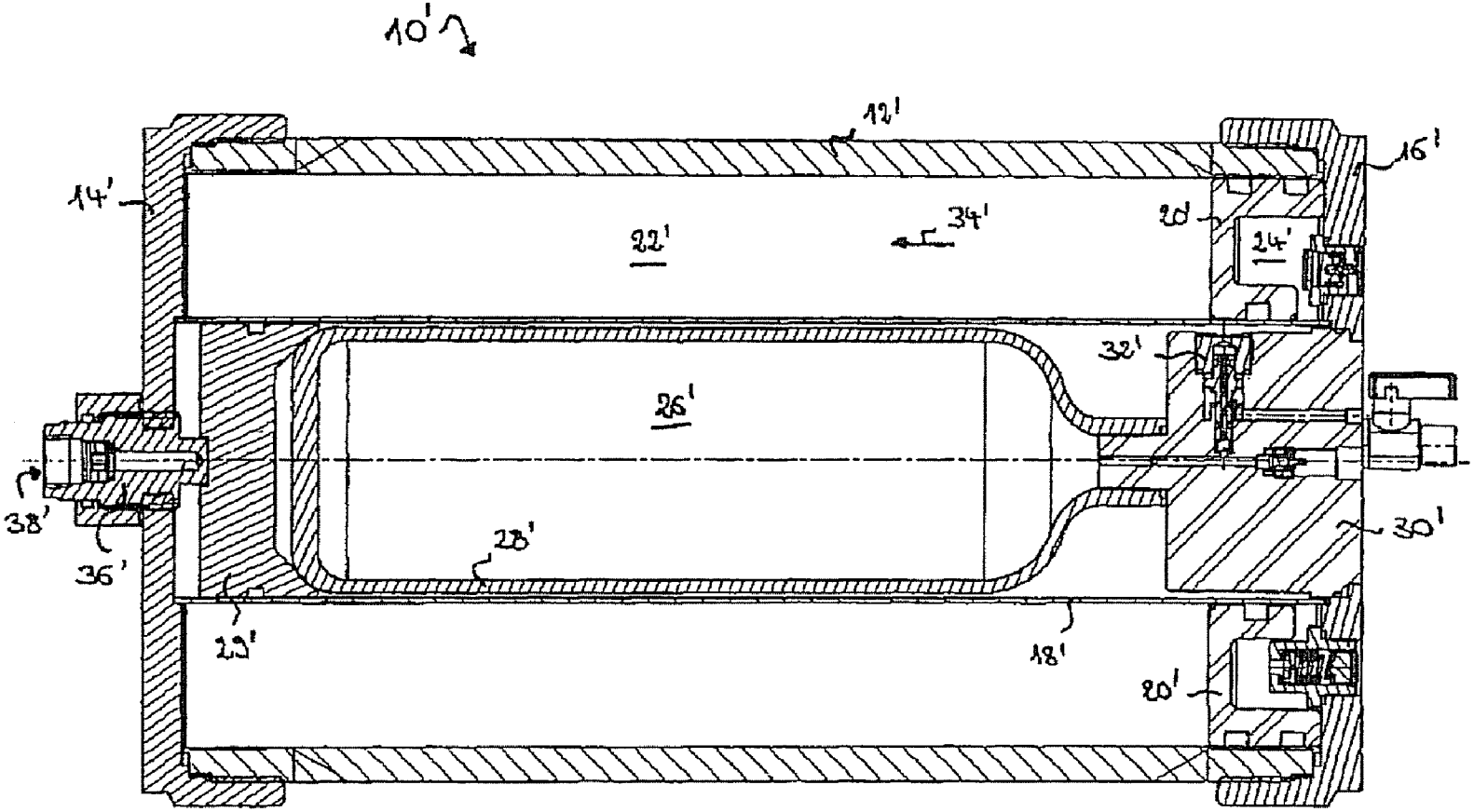
FIG. 1: shows a longitudinal section through a fire-extinguishing substance container according to a first embodiment of the invention.

FIG. 1 shows afire-extinguishing substance container according to a first embodiment of the invention, which is designated overall with reference sign 10'. The fire-extinguishing substance container 10' comprises a cylindrical container shell 12', which is closed in leakproof manner at both ends by a first closure 14' and a second closure 16'. The closures 14', 16' are screwed by means of internal threads onto an external thread on the container shell 12' and closed by means of sealing rings. A cylindrical guide shell 18' is arranged in the fire-extinguishing substance container 10' coaxially with the container shell 12'. A piston 20' surrounds the guide shell 18' and is mounted by the latter and the inner surface of the container shell 12' so as to be axially displaceable in the fire-extinguishing substance container 10'. The piston 20' takes the form of an annular piston with central guide bush. In the fire-extinguishing substance container 10' the piston 20' separates a fire-extinguishing substance compartment 22' from an expansion compartment 24'. A coaxial compressed gas chamber 26' located inside the fire-extinguishing substance container is in turn separated spatially from the fire-extinguishing substance compartment 22' and from the expansion compartment 24' by a compressed gas cylinder 28' of conventional construction. The compressed gas cylinder 28' and the compressed gas chamber 26' are located inside the guide shell 18', such that the piston 20' is displaceable over the guide shell 18' along the compressed gas chamber 26'. Thus, at least in the displacement region of the piston 20', the guide shell 18', the container shell 12' and the piston 20' all take the form of cylindrical bodies in the geometric sense (i.e. they are not necessarily circular-cylindrical).

In the case of the embodiment according to FIG. 1, a fittings block 30' is screwed onto the connecting thread in the cylinder neck of the compressed gas cylinder 28'. The fittings in the fittings block 30' (described in detail further below) serve inter alia for controlled pressurization of the expansion compartment 24' with propellant gas from the compressed gas cylinder 28'. As is additionally apparent from FIG. 1, the guide shell 18', the compressed gas cylinder 28' and the fittings block 30' are all held secure and protected against damage in the fire-extinguishing substance container 10' by corresponding shaping of the closures 14', 16' and a retainer 29'. As a result of the above-described arrangement, a compact, space-saving structure is achieved which makes it possible, without significant additional structural volume, to combine a piston fire-extinguishing substance container with a separate pressure accumulator. In fact, it should be noted that, for example with the design illustrated, the internal volume defined by the guide shell 18', including compressed gas cylinder 28' and fittings block 30', occupies only approx. 25% of the total useful volume of the fire-extinguishing substance container 10'. The separate compressed gas chamber 26' makes it possible to keep the volume needed for the propellant gas in the ready for service state comparable to or even smaller than in piston fire-extinguishing substance containers according to the previous prior art.

The internal volume defined by the guide shell 18' is closed relative to the outside and the fire-extinguishing substance compartment 22' by suitable seals. The piston 20' is provided with per se known O-ring seals at the inner surface of the container shell 12' and at the guide shell 18', which reliably prevent penetration of fire-extinguishing substance into the expansion compartment 24' and penetration of propellant gas into the fire-extinguishing substance compartment 22' even in the relatively long term, without the displaceability of the piston 20' being impaired disadvantageously.

The principle of operation of the fire-extinguishing substance container 10' may be summarized as follows. When ready for service, the fire-extinguishing substance compartment 22' is filled with a fire-extinguishing substance, such as for example water combined with an additive. Neither the fire-extinguishing substance compartment 22' nor the expansion compartment 24' are initially under pressure, i.e. the constant fire-extinguishing substance pressure in the ready for service state may be at atmospheric pressure, for example. In actual fact, the expansion compartment 24' is isolated when ready for service from the compressed gas cylinder 28' by a switching valve 32' in the fittings block 30'. When necessary, the switching valve 32' is tripped, for example by a detector device described below, such that only upon tripping does the propellant gas flow out of the compressed gas chamber 26' into the expansion compartment 24' (only from this point does the expansion compartment act as a "propellant compartment" for receiving the propellant from the compressed gas chamber as with the device known from WO 96/36398). The propellant gas is then preferably adjusted down to a predetermined extinguishing pressure, for example 4 bar, 15 bar or 90 bar by a pressure control valve or a pressure reducing valve in the fittings block 30' (not shown in FIG. 1). With exposure to the propellant gas, the piston 20' is displaced under a constant extinguishing pressure in the direction of arrow 34' into the original fire-extinguishing substance compartment 22'. When a predetermined pressure is reached, the fire-extinguishing substance is propelled out of the fire-extinguishing substance container 10' by a rupture diaphragm or a pressure relief valve 36' and is conveyed in known manner to the location requiring extinguishing by means of port 38'. In the process, the piston moves over the guide shell 18' along the compressed gas chamber 26' from closure 16' (as in FIG. 1) to closure 14' (not shown) and reaches the latter when the fire-extinguishing substance has been completely discharged. The compressed gas cylinder 28' is of course filled with propellant gas under a sufficient storage pressure, such that even in the case of relatively small leaks complete expulsion of all the fire-extinguishing substance is possible.

Figure 2:
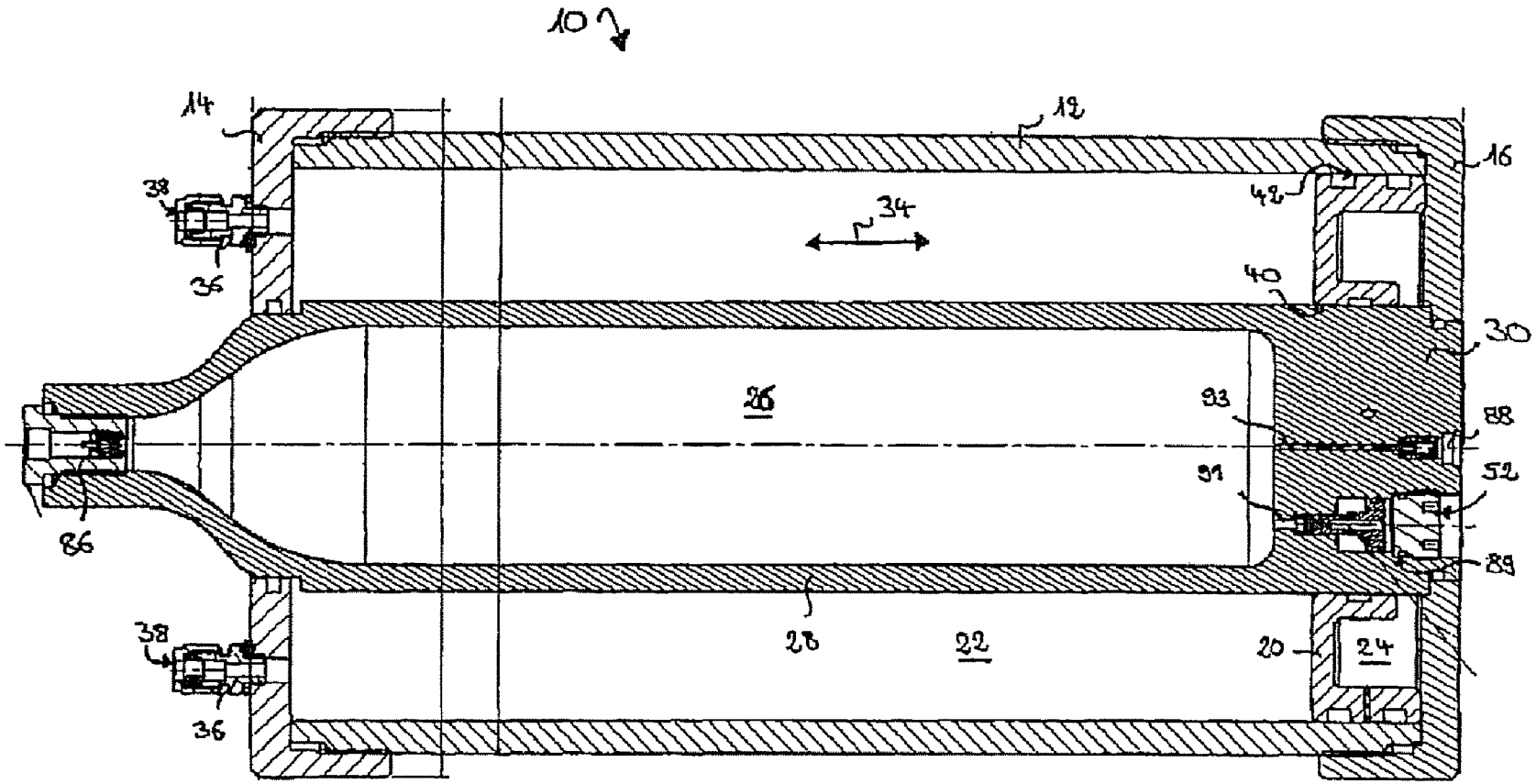
FIG. 2: shows a longitudinal section through a fire-extinguishing substance container according to a second embodiment of the invention.

FIG. 2 shows a longitudinal cross-section of a fire-extinguishing substance container 10 according to a second, further developed embodiment of the invention. Like the first embodiment, the fire-extinguishing substance container 10 comprises a container shell 12, which is closed at both ends by means of a first and a second closure 14, 16. A piston 20 is arranged axially displaceably in the container shell 12 and there separates a fire-extinguishing substance compartment 22 from an expansion compartment 24. A compressed gas chamber 26 located inside the fire-extinguishing substance container 10 is arranged in the fire-extinguishing substance container 10 coaxially with the container shell 12 for controlled pressurization of the expansion compartment 24. The piston 20 takes the form of an annular piston and is arranged so as to be displaceable along the compressed gas chamber 26. As is apparent from FIG. 2, unlike in the first embodiment the compressed gas chamber 26 is not spatially separated from the fire-extinguishing substance compartment 22 and from the expansion compartment 24 by means of an additional guide shell but rather is formed integrally and exclusively by a novel, cylindrical compressed gas cylinder 28. The embodiment according to FIG. 2 further differs in that the housings and valve seats for virtually all the necessary fittings are formed as bores in the novel compressed gas cylinder 28, or more precisely in the solid cylinder bottom thereof which is thicker than in conventional compressed gas cylinders. In other words, the cylinder bottom of the compressed gas cylinder 28 itself forms a fittings block 30, such that a plurality of fittings may be accommodated in the bottom of the compressed gas cylinder 28 in space-saving manner and protected against damage. Said fittings are explained in detail below.

FIG. 2 shows that the piston 20 is mounted directly on the outer surface of the compressed gas cylinder 28 so as to be axially displaceable according to arrows 34. It may here be advantageous for this outer surface to be machined to a perfect fit, but this is not absolutely necessary in the case of a sufficiently small manufacturing tolerance. It is also clear from FIG. 2 that the piston 20 comprises an inner guide bush 40 for guidance against the compressed gas chamber 26, i.e. the compressed gas cylinder 28, and an outer guide skirt 42 for guidance against the container shell 12. In this case, the guide bush 40 extends less far axially than the guide skirt 42. If the piston is displaced towards the first closure 14, the fire-extinguishing substance is propelled out of the fire-extinguishing substance container 10 via a pressure relief valve 36 (or a rupture diaphragm). A fire-extinguishing substance line is generally connected to the port 38, to convey the fire-extinguishing substance to the desired location. As FIG. 2 shows, a plurality of ports 38 may be provided, for example for supplying a plurality of fire-extinguishing substance lines leading to different places.

Before the second, further developed embodiment of the invention according to FIG. 2 is described in greater detail, first of all a number of variants of a fire-extinguishing device according to the invention will be explained, together with their modes of operation. Both the fire-extinguishing substance container 10' according to the first embodiment and the fire-extinguishing substance container 10 according to the second embodiment are suitable for the fire-extinguishing device described below, but for the sake of simplicity reference is made to the second embodiment.

Figure 3:
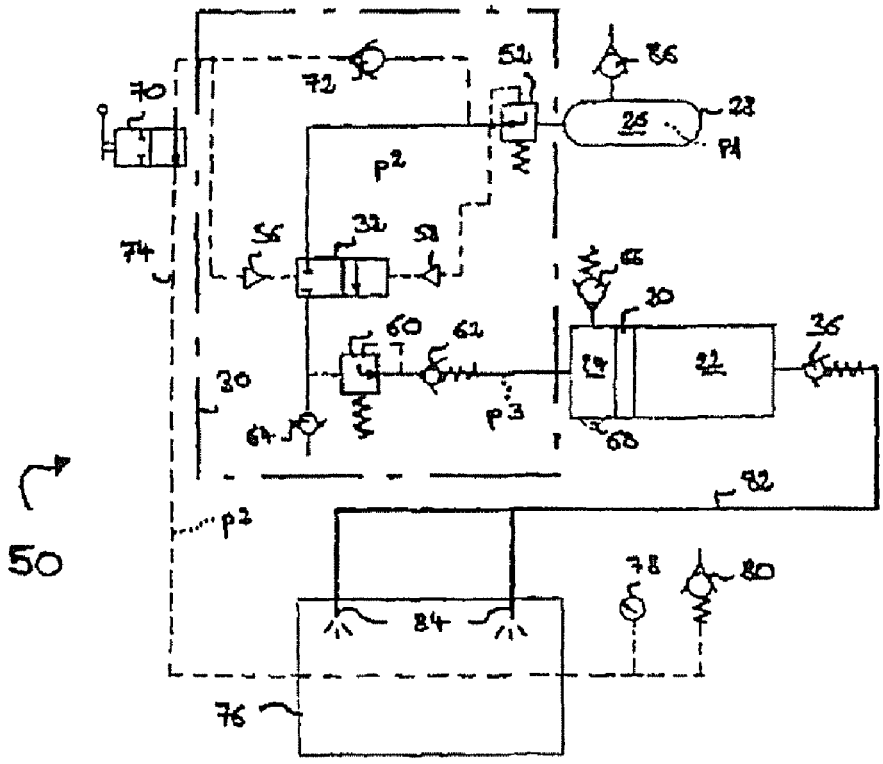
FIG. 3: is a schematic representation of a first fire-extinguishing device for low fire-extinguishing substance pressure with a fire-extinguishing substance container according to the invention.

FIG. 3 shows a first fire-extinguishing device 50 for low fire-extinguishing substance pressure (for example 4 bar) in a simplified, schematic representation. The fire-extinguishing device 50 comprises the fire-extinguishing substance container 10 with axially displaceable piston 20, which separates the fire-extinguishing substance compartment 22 from the expansion compartment 24. According to the invention, the pressure reservoir 28 with the compressed gas chamber 26 is arranged in the fire-extinguishing substance container 10. It should be noted that, for clarity's sake, in FIGS. 3 to 5 the compressed gas chamber 26 and the compressed gas cylinder 28 are not incorporated into the fire-extinguishing substance container 10 but rather are illustrated separately. The fittings block 30 connects the interior of the compressed gas cylinder 28 inter alia to the expansion compartment 24 via various valves.

Connected directly to the outlet of the compressed gas cylinder 28 is a first pressure control valve 52, which reduces a storage pressure p1 (e.g. 200 bar) of the propellant in the compressed gas cylinder 28 to a first intermediate pressure p2 (e.g. 15 bar). A switching valve 32 is connected to the outlet of the pressure control valve 52. The switching valve 32 is, for example, a 2/2-way valve with blocking in the counterflow direction and comprising pneumatic control ports 56, 58. The outlet of the switching valve 32 is connected to a second pressure control valve 60, which reduces the intermediate pressure p2 to a propelling pressure or extinguishing pressure p3 (for example 4 bar) for the expansion compartment 24. Alternatively, the pressure control valve 60 could also be arranged directly upstream of the switching valve 32. The outlet of the second pressure control valve 60 is connected via a spring-loaded pressure relief valve 62 (or a rupture diaphragm) to the expansion compartment 24 of the fire-extinguishing substance container 10. The pressure relief valve 62 is set to a specific minimum pressure (less than p3), which must be applied in order to fill the expansion compartment. Furthermore, the outlet of the switching valve 32 is connected to the outside via a creeping gas safety device 64.

The non-ideal long-term sealing of the switching valve 32 is compensated by means of preferably likewise non-ideal or poorer long-term sealing of the creeping gas safety device 64 relative to the outside. This, together with suitable pretensioning at the non-return valve 62, prevents a creeping pressure build-up in the expansion compartment 24. The creeping gas safety device 64 does not dissipate short-term pressure changes, however.

FIG. 3 additionally shows a spring-loaded pressure relief valve 66 connected to the expansion compartment 24, which valve ensures a maximum propellant pressure, with a value greater than p3, in the expansion compartment 24 by suitable pretensioning in the case of a defect for example at one of the pressure control valves 52, 60. This prevents possible damage caused to people and equipment for instance by explosion of the pressure medium container 10. A manual vent valve 68 simplifies filling of the fire-extinguishing substance container 10, more precisely of the fire-extinguishing substance compartment 22, with fire-extinguishing substance, in that the resultant back-pressure in the expansion compartment 24 may be dissipated. FIG. 3 also shows the spring-loaded pressure relief valve 36 at the outlet of the fire-extinguishing substance container 10, which valve allows the fire-extinguishing substance to escape only if a predetermined pressure (with a value of less than p3) set by pretensioning is exceeded. This prevents undesirable escape of fire-extinguishing substance, for example in the event of a temperature-determined change in volume. It is clear from the above explanations that it is sufficient for the fire-extinguishing substance container to be designed for a pressure, which only slightly exceeds the pressure p3.

FIG. 3 likewise shows a ball valve 70 connected to the fittings block 30, which ball valve 70 is connected on the one hand to the first control port 56 of the switching valve 32 and additionally via a non-return valve 72 to the outlet of the first pressure control valve 52, and on the other hand to a detector line 74.

When ready for service, the ball valve 70 is open, such that the detector line 70 is connected directly to the first control port 56 of the switching valve 32. The ball valve 70 serves inter alia for replacement of the detector line 74 after use. The detector line 74 comprises a special hose, which is pressurized with gaseous pressure medium. This pressurized special hose is fitted above a point 76 potentially at risk of fire. It consists of a specially developed, ageing-resistant, diffusion-tight polymer material and is designed such that the hose wall bursts open for example at a temperature of between 100 and 110° C. and allows the gaseous pressure medium to escape. Furthermore, as shown in FIG. 3, a manometer 78 is connected for monitoring purposes and a filling port 80 is connected for initial pressurization to the detector line 74. The non-return valve 72 is located in an equalizing line, which, by means of a small diameter line, serves by means of propellant gas from the compressed gas container 28 to compensate a potential longer-term pressure drop, caused for example by non-ideal tightness of the ball valve 70, of the filling port 80 or other microleaks. In this case, the non-return valve 72 prevents a loss of propellant via the equalizing line in the event of activation of the detector line 74. The mode of operation is similar to that of the creeping gas safety device 64.

The mode of operation of the fire-extinguishing device 50 with the detector line 74 will be described in brief below. When ready for service, the pressure in the detector line 74 is set to p2, i.e. equal to the pressure at the outlet of the first pressure control valve 52. As soon as the pressure in the detector line 74 drops, a pressure difference arises between the control ports 56, 58, whereby the switching valve 32 opens without external energy. A pressure drop in the detector line 74 naturally arises when, in the event of fire, the detector line 74 bursts open through the action of heat at any point, in particular at the at-risk point 76 requiring protection. When the switching valve 32 is open, the expansion compartment 24 is supplied with propellant at a constant pressure p3 from the compressed gas cylinder 28 via the two pressure control valves 52, 60.

In this way, the piston 20 is moved towards the fire-extinguishing substance compartment 24, such that the latter decreases continuously in size, and the fire-extinguishing substance is propelled out of the fire-extinguishing substance container 10 via the pressure relief valve 36. It should be noted that, due to the above-described arrangement, the fire-extinguishing substance is expelled at a constant throughput and pressure p3 over the entire discharge period.

The fire-extinguishing substance is conveyed to atomizing nozzles 84 of known construction via a fire-extinguishing substance line 82, to which nozzles the pressure p3 of the fire-extinguishing substance is optimally matched over the entire extinguishing process. The fire-extinguishing substance, which fights the fire, is discharged via the atomizing nozzles 84 at the location at risk.

Figure 4:
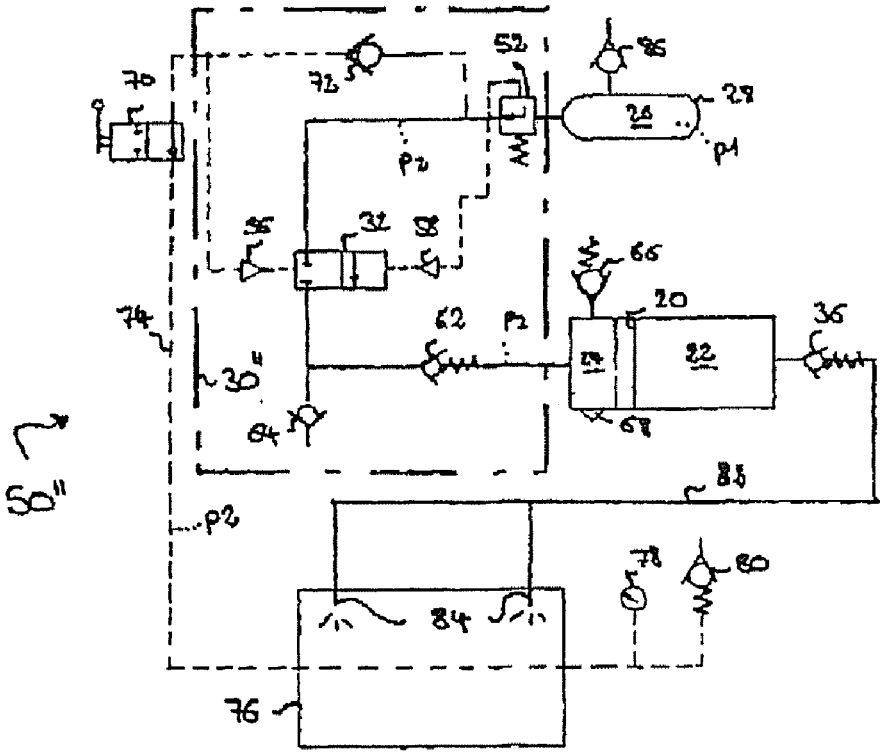
FIG. 4: is a schematic representation of a second fire-extinguishing device for moderate fire-extinguishing substance pressure with a fire-extinguishing substance container according to the invention.

FIG. 4 is a simplified, schematic representation of a fire-extinguishing device 50" according to a second variant for moderate fire-extinguishing substance pressure (for example 15 bar). The configuration of the second fire-extinguishing device 50" corresponds substantially to that of the first fire-extinguishing device 50. The fire-extinguishing device 50" differs merely in that no second pressure control valve is present. Thus, the fire-extinguishing substance pressure during the extinguishing process corresponds to the pressure p2 (e.g. 15 bar) at the outlet of the first pressure control valve 52 and in the detector line 74. This variant with single-stage pressure reduction is thus suitable for example for fire-extinguishing substances and in particular for fire-extinguishing nozzles 80 which are used at moderate pressure p2. Since, apart from the different extinguishing pressure and the correspondingly modified fittings block 30", the mode of operation and structure of the fire-extinguishing device 50" correspond substantially to that explained above, the explanation is not repeated here.

Figure 5:
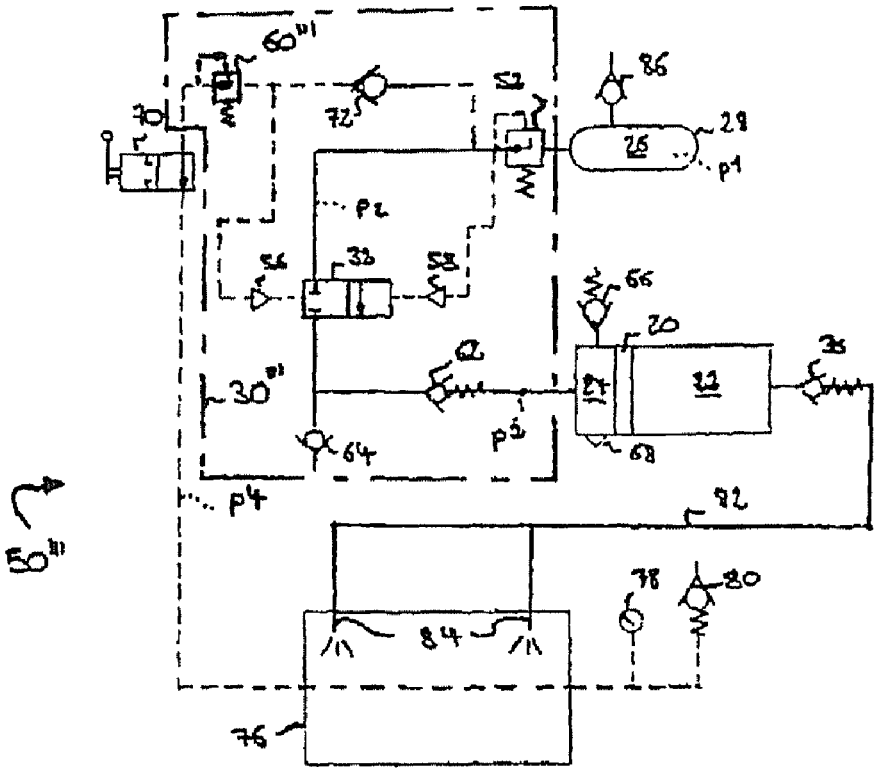
FIG. 5: is a schematic representation of a third fire-extinguishing device for high fire-extinguishing substance pressure with a fire-extinguishing substance container according to the invention.

FIG. 5 is a simplified, schematic representation of a fire-extinguishing device 50'" according to a third variant for high fire-extinguishing substance pressure (for example 90 bar). In contrast to the first and second variant, in the third variant a second pressure control valve 60'" is arranged between the ball valve 70 and the non-return valve 72, upstream of the tap for the first control port 56. This makes it possible to select a significantly higher pressure p2 at the outlet of the first pressure control valve 52 (e.g. 90 bar) while retaining a moderate pressure p4 (e.g. 15 bar) in the detector line 72 by means of the second pressure control valve 60'". As is apparent from FIG. 5, the pressure p2 in this variant corresponds to the extinguishing pressure during the extinguishing process. This variant is thus suitable in particular for fire-extinguishing substances and for fire-extinguishing substance nozzles which are intended for use at a relatively high pressure p2. Since the mode of operation and structure otherwise correspond to that described above, unnecessary repetition is also avoided here.

With reference to FIG. 2 and FIGS. 6-15, the structure of the fire-extinguishing substance container 10 and in particular of the compressed gas cylinder 28 and the fittings block 30 incorporated therein is explained in greater detail below. It should be noted in this respect that the fire-extinguishing substance container 10 and fittings block 30 in these Figures correspond in structure to the schematic representation according to FIG. 3, i.e. the first fire-extinguishing device 50 for relatively low fire-extinguishing pressure (e.g. 4 bar). However, the person skilled in the art will be able straightforwardly to effect the necessary adaptations corresponding to the second and third variants for moderate or high extinguishing pressure.

FIG. 2 shows the first pressure control valve 52 in cross-section, this being arranged as a first pressure-reducing stage with a correspondingly constructed, multistage housing and valve seat bore 89 in the thickened bottom of the compressed gas cylinder 28. FIG. 2 also shows a bursting disc device 88, which guarantees the maximum internal pressure in the compressed gas cylinder 28, in order for example to prevent an explosion caused by overheating in the event of fire. The thickened base plate, which constitutes the main body of the fittings block 30, serves as housing for both fittings and also as valve seat for the pressure control valve 52. It is apparent from FIG. 2 that the pressure control valve 52 is connected via a connecting bore 91 directly to the interior of the compressed gas cylinder 28. The bursting disc device 88 also comprises a multistage bore and is connected to the interior by means of a connecting bore 93. In the neck of the compressed gas cylinder 28 there is provided a filling or test port 86, via which the compressed gas cylinder 28 may be refilled or tested.

Figure 6:
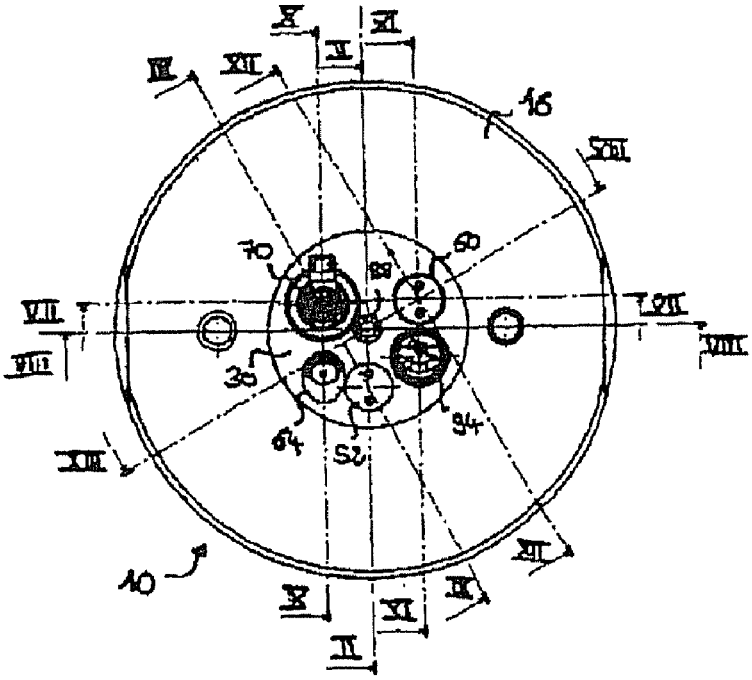
FIG. 6: is an end view of the fire-extinguishing substance container according to FIG. 2.

FIG. 6 shows the fire-extinguishing substance container 10 in end view from the end of the second closure 16. In addition to the various section planes of FIGS. 2 and 7-13. FIG. 6 shows the externally accessible fittings in the fittings block 30, namely first and second pressure control valves 52, 60; creeping gas safety device 64; ball valve 70; bursting disc device 88; and a high pressure manometer 94 for checking the internal pressure of the pressure cylinder 28.

Figure 7:
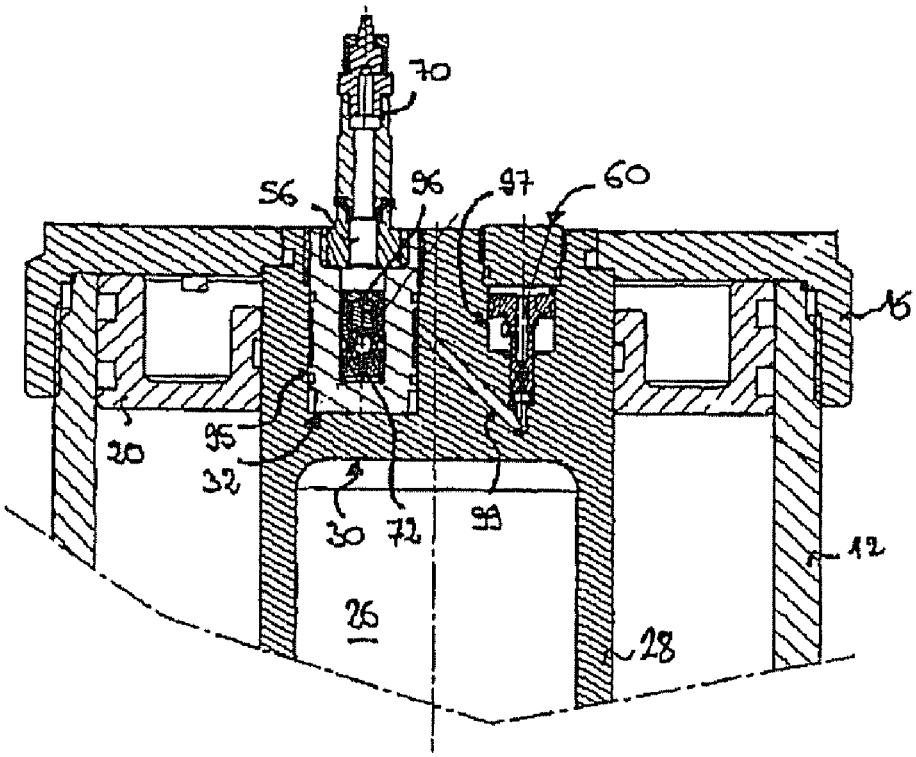
FIG. 7: shows a partial longitudinal section through the fire-extinguishing substance container along section plane VII-VII in FIG. 3.
Figure 9:
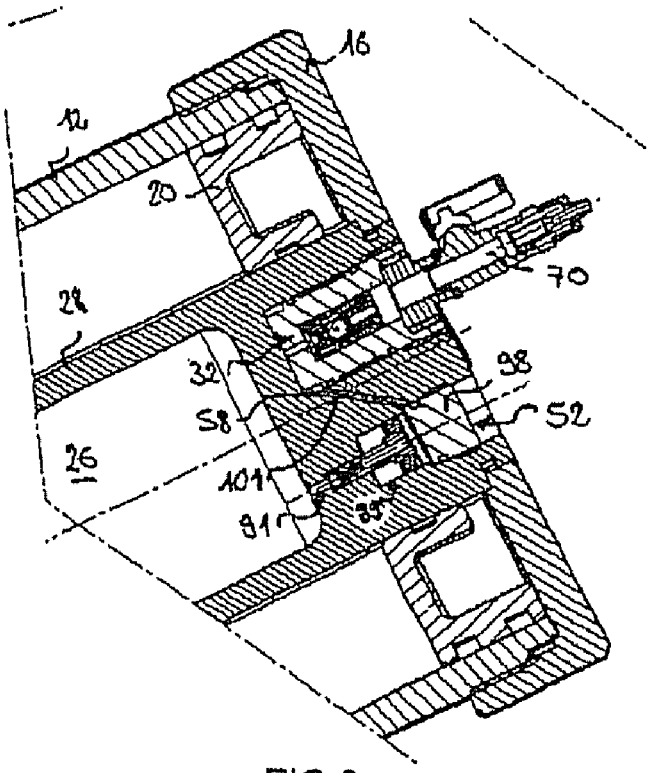
FIG. 9: shows a partial longitudinal section through the fire-extinguishing substance container along section plane IX-IX in FIG. 3.

FIG. 7 shows the fire-extinguishing substance container 10 in partial longitudinal section in the region of the fittings block 30. The switching valve 32 is arranged with a corresponding multistage housing and valve seat bore 95 in the fittings block 30. The switching valve 32 comprises an internal, axially displaceable control piston 96, which is held in position or displaced by means of the control ports 56, 58 (58 is shown in FIG. 9). The ball valve 70 is connected to the first control port 56 with a connecting nipple for the detector line. FIG. 7 likewise shows the preferred configuration of the non-return valve 72. The non-return valve 72 is accommodated in the control piston 96 as a blocking element for and together with a central, multistage through-hole (see FIG. 10). FIG. 7 further shows the second pressure control valve 60 and the housing and valve seat bore 97 therefore in the fittings block 30. Connection between the outlet of the switching valve 32 and the second pressure control valve 60 is ensured by a connecting bore 99, which is positioned obliquely relative to the longitudinal axis of the compressed gas cylinder 28.

Figure 8:
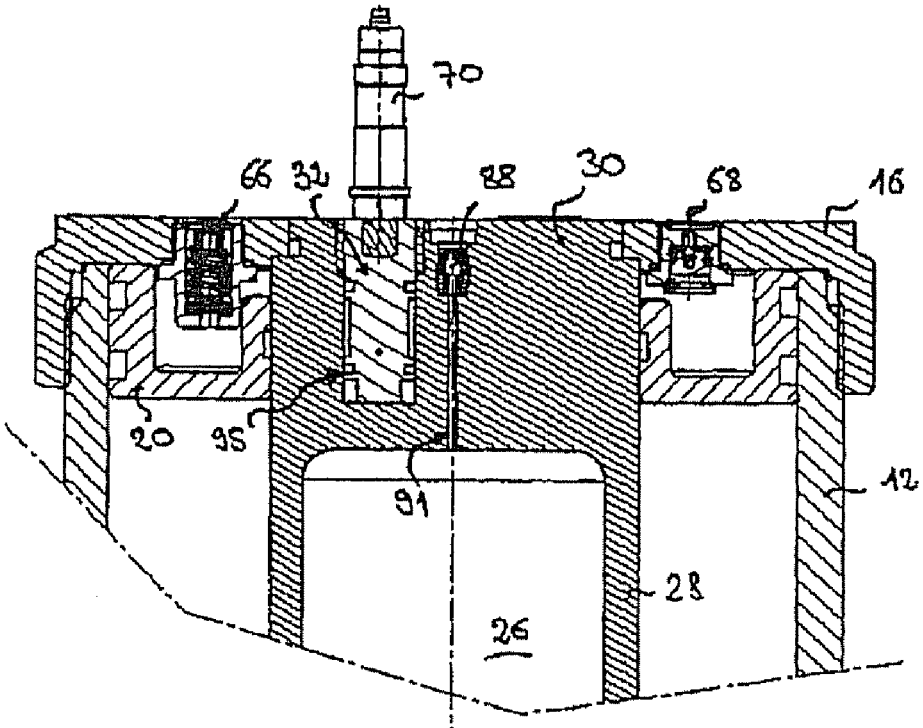
FIG. 8: shows a partial longitudinal section through the fire-extinguishing substance container along section plane VIII-VIII in FIG. 3.

In addition to a further view of the switching valve 32 and the bursting disc device 88, FIG. 8 shows the pressure relief valve 66 and the vent valve 68, which are screwed into the second closure and connected directly to the expansion compartment 24.

FIG. 9 shows a further view of the switching valve 32 and of the first pressure control valve 52. FIG. 9 shows in particular the connection between the outlet of the first pressure control valve 52 and the inlet of the switching valve 32, which is ensured by a corresponding connecting bore 101 in the thickened cylinder bottom, the latter extending obliquely relative to the longitudinal axis of the compressed gas cylinder 28. As is clear from FIG. 9, the inlet of the switching valve 32 coincides with the control port 58. FIG. 9 also shows a valve insert 98, which together with the housing and valve seat bore 89 forms the first pressure control valve 52.

Figure 10:
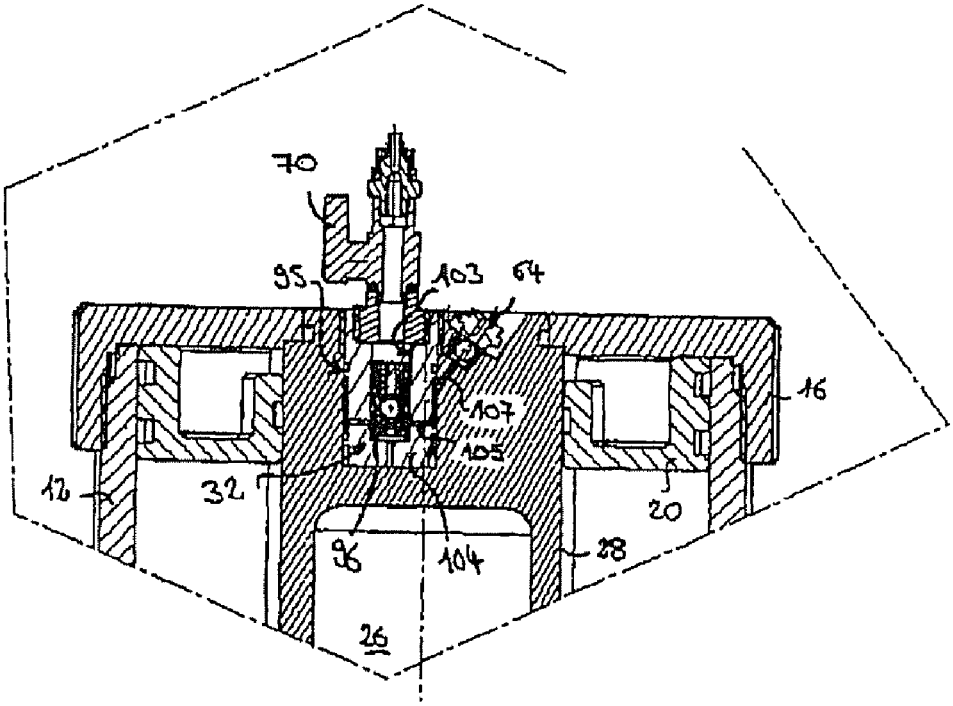
FIG. 10: shows a partial longitudinal section through the fire-extinguishing substance container along section plane X-X in FIG. 3.

FIG. 10 shows more precisely the mode of operation and structure of the switching valve 32. The control piston 96 is guided axially displaceably in a perfectly fitting axial blind bore 103 in a valve insert 104 of the switching valve 32. A transverse bore 105 in the valve insert 104 forms the switchable connection between the inlet and the outlet of the switching valve 32.

The non-operative and initial position of the control piston 96 is set to "closed", i.e. in abutment against the closed end of the blind bore 103. This is achieved by means of appropriately selected pressure effect cross-sections on the control piston 96 of the control valve 32. If a positive pressure difference arises between the first control port 56 and the second control port 58, i.e. the pressure at the control port 56 is less than at the control port 58, the control piston 96 is displaced towards the first control port 56 into the "open" position. In this way, a passage is opened up from the inlet of the control valve 32 (which coincides with the second control port) via the transverse bore 105 to the outlet of the control valve, i.e. towards the second pressure control valve 60.

FIG. 10 also shows the creeping gas safety device 64, which lets slowly building up pressure out to the outside via an obliquely positioned connecting bore 107. The creeping gas safety device 64 is constructed according to FIG. 10 as an appropriately designed non-return valve.

Figure 11:
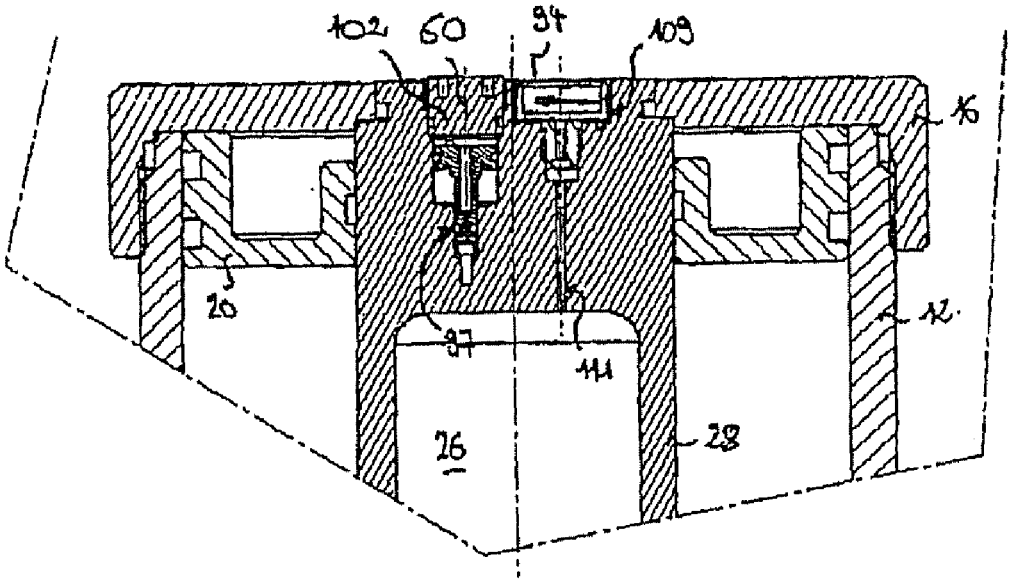
FIG. 11: shows a partial longitudinal section through the fire-extinguishing substance container along section plane XI-XI in FIG. 3.

FIG. 11 shows the second pressure control valve 60 and the high pressure manometer 94 in longitudinal cross-section. In addition to the housing and valve seat bore 97 for the second pressure control valve 60, FIG. 11 shows a multistage receiving bore 109 for the high pressure manometer 94 in the fittings block 30. The receiving bore 109 leads axially into a connecting bore 111, which connects the high pressure manometer 94 to the interior of the compressed gas cylinder 28. FIG. 11 also shows a valve insert 102, which together with the housing and valve seat bore 97 forms the second pressure control valve 60.

Figure 12:
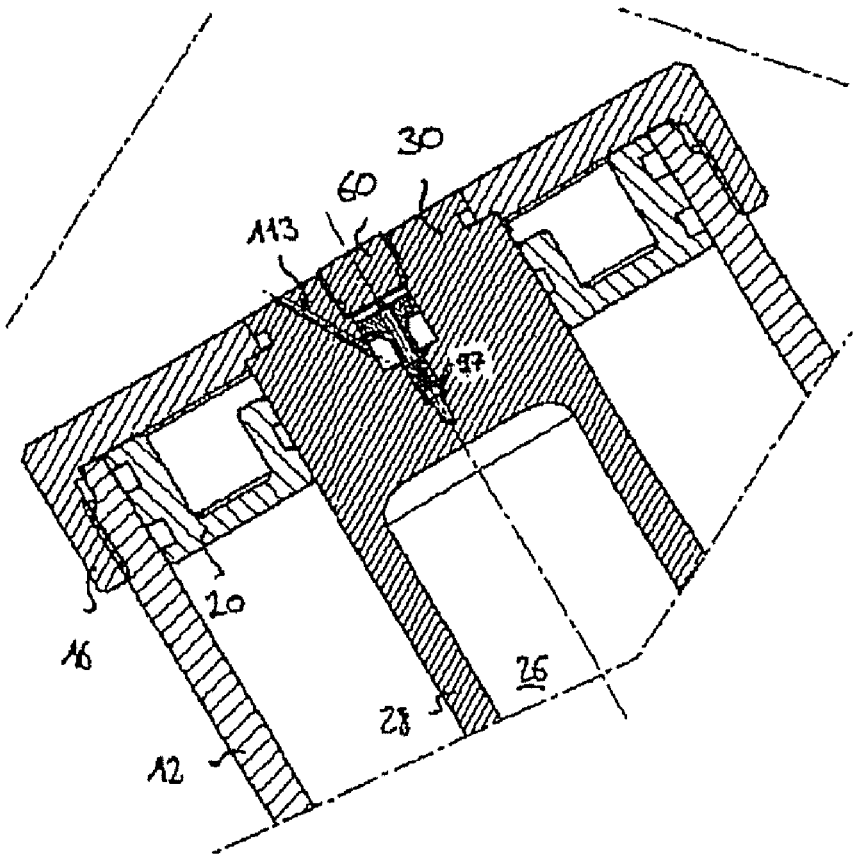
FIG. 12: shows a partial longitudinal section through the fire-extinguishing substance container along section plane XII-XII in FIG. 3.
Figure 13:
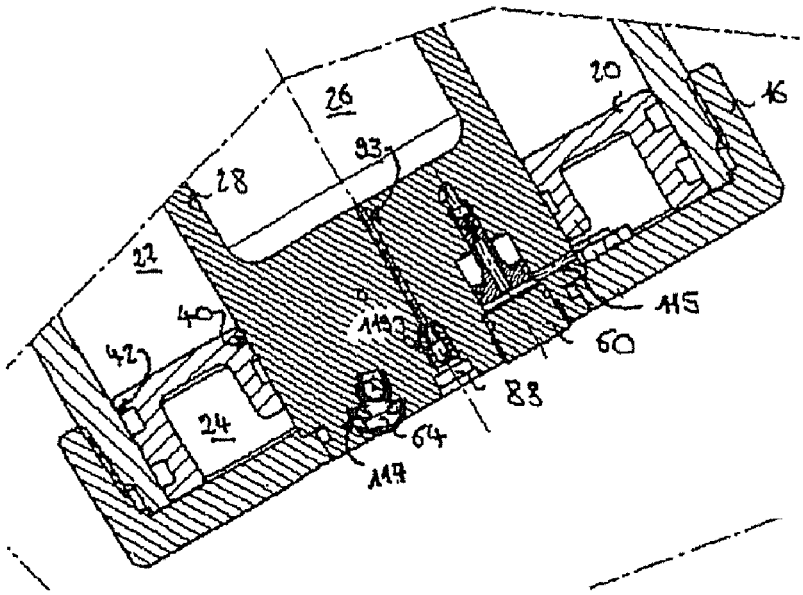
FIG. 13: shows a partial longitudinal section through the fire-extinguishing substance container along section plane XIII-XIII in FIG. 3.

FIG. 12 and FIG. 13 show further cross sections of the fittings block 30 in the bottom of the compressed gas cylinder 28. An outlet bore 113 connects the second pressure control valve 60 to the outside, in order to allow a reduction in pressure, as shown in FIG. 12. By venting the spring adjustment chamber of the pressure control valve 60 to the atmosphere, the outlet bore 113 ensures a pressure difference either side of the valve piston. FIG. 13 again shows the second pressure control valve 60, the creeping gas safety device 64 and the bursting disc device 88. FIG. 13 shows in particular an outlet bore 115 in the fittings block 30 extending transversely of the longitudinal axis of the compressed gas cylinder 28. The outlet bore 115 leads on the one hand into the outlet of the second pressure control valve 60 and on the other hand into the expansion compartment 24 and forms the outlet opening of the compressed gas cylinder 28, i.e. the compressed gas chamber 26 for controlled pressurization of the expansion compartment 24. As a result of the above-mentioned, shorter axial extent of the guide bush 40 of the piston 20, the mouth of the outlet bore 115 into the expansion compartment 24 is always open. FIG. 13 also shows the receiving bores 117, 119 for the creeping gas safety device 64 or for the bursting disc device 88.

Production of the novel compressed gas cylinder 28 according to FIG. 2 is explained below with reference to FIG. 14 and FIG. 15. A production method for such a compressed gas cylinder 28 comprises the following steps:

- providing a blank, which is suitable with regard to material (preferably aluminium) and shape (preferably that of a circular-cylindrical solid body) for a shaping method using indirect extrusion;
- indirectly extruding the blank using appropriate dies to produce a formed article, in such a way that a portion remaining from the blank constitutes a cylinder bottom and a cylindrical cylinder shell is formed by the indirect extrusion, which is closed at one end by the cylinder bottom;
- producing a compressed gas cylinder blank 200 by shaping the formed article, more precisely the cylindrical cylinder shell 204, to produce a neck 206 in the opposite end region from the cylinder bottom 202;
- processing the compressed gas cylinder blank 200 to produce a compressed gas cylinder.

The method is characterized in that on the one hand the indirect extrusion is performed in such a way that the cylinder bottom takes the form of a solid, thickened base plate 202, i.e. of a solid body, and on the other hand processing of the compressed gas cylinder blank 200 to produce a compressed gas cylinder at least includes formation of a receiving bore for a valve in the solid, thickened base plate 202.

Figure 14:
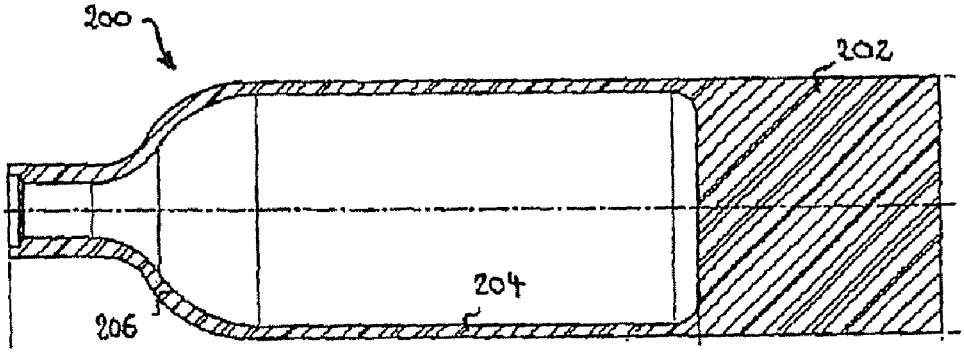
FIG. 14: shows a longitudinal section through a compressed gas cylinder blank for use in a fire-extinguishing substance container according to FIG. 2.

FIG. 14 shows a possible compressed gas cylinder blank 200 produced with this method with a solid, thickened base plate 202 as cylinder bottom, a cylinder shell 204 adjoining it and a cylinder neck 206. Prior to further processing, the solid, thickened base plate 202 forms a cylindrical solid body with the same radius as the cylinder shell 204. The numbers between parentheses used below relate to examples from FIGS. 2 and 6 to 13.

Formation of a receiving bore for a valve during processing of the compressed gas cylinder blank 200 to produce a compressed gas cylinder 28 includes for example formation of at least one housing and valve seat bore (89; 95; 97), and in general at least one connecting bore (91; 93) to the interior of the compressed gas cylinder and at least one outlet bore (115) to the outside in the thickened, solid base plate 202. Such receiving and connecting bores produce from the originally solid, thickened cylinder bottom 202 a fittings block 30 in which the valves and fittings necessary for use of the compressed gas cylinder 28 may be fully installed. A variant of a compressed gas cylinder 280 produced in this way is shown in FIG. 15. Although receiving bores are preferably provided which assume the twin functions of valve seat and valve housing, it is likewise feasible to provide receiving bores, which serve merely as receptacles for conventional valves. The latter variant, however, does not have the advantage of the connecting sealing surface of a conventional valve with its own housing being unnecessary if the receiving bore also constitutes the valve seat.

It should be noted that by means of such a production method a compressed gas cylinder 28, 280 is produced in which a fittings block 30 is an integral component of the compressed gas cylinder 28, 280. This is made possible in particular by the solid, thickened base plate 202 produced during indirect extrusion, which forms the cylinder bottom and serves as a base member for the fittings block 30 produced later in the method.

To be able to accommodate the valves and fittings, the solid, thickened base plate 202 extends preferably at least 50 mm after indirect extrusion and may amount to 5 to 15 times the wall thickness of the cylinder shell.

Of course, a plurality of housing and valve seat bores (89; 95; 97) may be accommodated in the solid, thickened base plate 202. The line connections between the valves installed later therein are preferably formed by connecting bores (99, 101, 107) in the thickened, solid base plate 202, which bores extend obliquely relative to the longitudinal axis of the compressed gas cylinder.

This makes it possible to effect machining of the compressed gas cylinder blank 200 very largely from the end face of the base plate 202. As is apparent from FIGS. 2 and 7-13, the housing and valve seat bore (89; 95; 97) are multistage bores, which correspond to the components to be accommodated.

Figure 15:
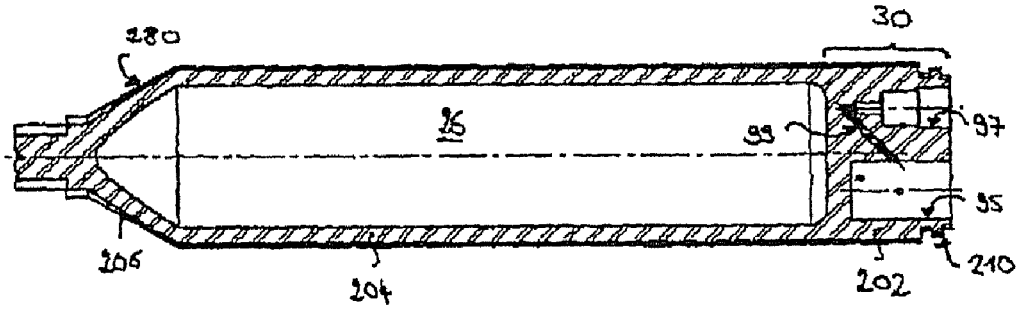
FIG. 15: shows a longitudinal section through a machined, alternative compressed gas cylinder blank for use in a fire-extinguishing substance container according to FIG. 2.

With regard in particular to a compressed gas cylinder 280 as shown in FIG. 15, which is suitable for installation in a fire-extinguishing substance container 10 according to the second embodiment in FIG. 2, the production method preferably additionally comprises one or more of the following steps:

- fitting a port in the cylinder neck 206, for example a filling or test port (86), or leakproof sealing of the cylinder neck 206;
- dimensionally and geometrically accurately machining the outer surface of the cylinder shell 204 to form a cylindrical guide for an annular piston (20), for example using a material-removing lathe tool;
- forming one or more receiving bores (109, 117, 119) for fittings (64, 88, 94) which do not function as valves and optionally correspondingly one or more connecting bores (93; 111) to the compressed gas chamber 26 of the compressed gas cylinder 280 or indeed one or more connecting bores (107) to a housing and valve seat bore (89; 95; 97).
- dimensionally and geometrically accurately reaming the housing and valve seat bore(s) (89; 95; 97) and/or the receiving bore(s) (109, 117, 119) in the base plate 202 for installation of corresponding valve inserts (98, 102, 104);
- forming internal threads in the housing and valve seat bore(s) (89; 95; 97) and/or in the receiving bore(s) (109, 117, 119) within the thickened base plate 202, such that valve inserts (98, 102, 104) or fittings (64, 88, 94) with corresponding external threads may be screwed in;
- installing valve inserts (98, 102, 104) and optionally other fittings (64, 88, 94) in the corresponding housing and valve seat bore(s) (89; 95; 97) and/or in the receiving bore(s) (109, 117, 119)
- (optionally) forming an outer, circumferential mounting groove (see FIG. 2) in the region of the cylinder neck 206 and/or a mounting groove 210 in the region of the base plate 202, these cooperating with corresponding closures 14, 16 to mount the compressed gas cylinder 28 in a fire-extinguishing substance container 10.

It goes without saying that not all of these steps are necessary for producing a compressed gas cylinder with valves and fittings incorporated into the cylinder bottom. Important advantages of such a compressed gas cylinder 28, 280 are for example:

- improved protection of the valves and fittings against damage in that the valves and fittings may be installed in protected manner in the cylinder bottom;
- improved tightness, due to avoidance of the conventional sealing surface at the cylinder neck;
- compact, space-saving construction, due to incorporation of the valves/fittings into the cylinder bottom.

It should be noted that such a novel compressed gas cylinder may prove eminently advantageous in other fields of application. It is of interest in particular for applications where safety is important, for example in the medical field in addition to fire-extinguishing technology, for example for emergency breathing apparatus, due to the avoidance of potential damage or shearing off of the valves/fittings during transportation of the compressed gas cylinder. The compact and safe construction of such a compressed gas cylinder is also advantageous in other fields in which small cylinder systems are used, such as for example in beverage technology for the carbonation of beverages.

Finally, some of the various advantages of both embodiments of the fire-extinguishing substance container according to FIG. 1 and FIG. 2 should additionally be mentioned. An important advantage consists in the fact that controlled pressurization of the expansion compartment 24; 24' is made possible by the separation of the expansion compartment 24; 24' from the compressed gas chamber 26; 26'. A switching valve 32; 32' for controlled pressurization of the expansion compartment may be provided, such that neither the fire-extinguishing substance compartment 22; 22' nor the expansion compartment 24; 24' is at operating pressure in the non-operative, ready for service state. This on the one hand reduces susceptibility to leaks and on the other hand the structural requirements for the fire-extinguishing substance container 10; 10'. Due to the separate compressed gas chamber 26; 26', it is also possible to provide a pressure control valve 52 (not shown in FIG. 1) The pressure control valve 52 prevents the fire-extinguishing substance pressure from falling undesirably in the fire-extinguishing substance compartment 22; 22' and thus the fire-extinguishing substance throughput from falling during the extinguishing process. This brings about an improvement in the match between fire-extinguishing substance pressure and atomizing nozzles 80 conventionally connected to the outlet of the fire-extinguishing substance container. Because the piston 20; 20' is arranged axially displaceably around the compressed gas chamber 26; 26', the advantages of a piston fire-extinguishing substance container are retained in space-saving manner, and in particular the above advantages are made possible without an additional external pressure reservoir. Due to this construction, the fire-extinguishing substance container 10; 10' may be installed, removed and optionally replaced as a compact module including pressure reservoir 28; 28' and fittings, for example for statutory maintenance purposes.

The second embodiment according to FIG. 2 gives rise to further advantages.

On the one hand, this fire-extinguishing substance container 10 is of a particularly space-saving construction, since special holders for the compressed gas cylinder 28 are dispensed with, and the fittings are installed as far as possible in the fittings block 30 incorporated into the compressed gas cylinder 28. This latter additionally protects the fittings from damage, for example in the event of transportation or of improper use. Furthermore, storage of the propellant gas is improved with regard to the leakproofness thereof, in that at least one sealing surface between cylinder neck and fittings is dispensed with.

Finally, it should be noted that each of the fire-extinguishing devices 50, 50", 5'" forms an automatic safety device operating without external energy, which is triggered automatically in the event of fire.

The invention claimed is:

1. A fire-extinguishing device comprising a fire-extinguishing substance container having:

a container shell closed at both ends; and a piston displaceable axially in said container shell, said piston separating a fire-extinguishing substance compartment from an expansion compartment in said fire-extinguishing substance container;

a compressed gas reservoir located inside said fire-extinguishing substance container, said reservoir comprising a compressed gas chamber, said chamber being separated spatially from said expansion compartment, for storing a propellant gas at high storage pressure and for controlled pressurization of said expansion compartment with reduced extinguishing pressure; and said piston being arranged to be displaceable along said compressed gas chamber.

2. The fire-extinguishing device according to claim 1, wherein said compressed gas reservoir takes a form of a compressed gas cylinder located inside said fire-extinguishing substance container and having an at least partially cylindrical outer wall, and wherein said piston takes a form of an annular piston which is guided displaceably along a cylindrical part of said at least partially cylindrical outer wall of said compressed gas cylinder.

3. The fire-extinguishing device according to claim 1, further comprising a cylindrical guide shell located inside said fire-extinguishing substance container, said compressed gas reservoir taking a form of a compressed gas cylinder arranged within said cylindrical guide shell, and said piston taking a form of an annular piston guided displaceably along said cylindrical guide shell.

4. The fire-extinguishing device according to claim 1, further comprising a switching valve for controlled pressurization of said expansion compartment, said switching valve being connected on an inlet side of said switching valve to said compressed gas chamber and on an outlet side of said switching valve to said expansion compartment, in order to supply compressed gas to said expansion compartment through opening of said switching valve.

5. The fire-extinguishing device according to claim 4, further comprising a pressure control valve for controlled pressurization of said expansion compartment, which is connected to said inlet or to said outlet of said switching valve in order to pressurize said expansion compartment with compressed gas at a reduced, substantially constant extinguishing pressure during said extinguishing process.

6. A fire-extinguishing device comprising:

a fire-extinguishing substance container having:

a container shell closed at both ends;

a piston displaceable axially in said container shell, said piston separating a fire-extinguishing substance compartment from an expansion compartment in said fire-extinguishing substance container; and a compressed gas reservoir located inside said fire-extinguishing substance container, said reservoir comprising a compressed gas chamber, said chamber being separated spatially from said expansion compartment, for storing a propellant gas at high storage pressure and for controlled pressurization of said expansion compartment with reduced extinguishing pressure; and a switching valve for controlled pressurization of said expansion compartment, said switching valve being connected on an inlet side of said switching valve to said compressed gas chamber and on an outlet side of said switching valve to said expansion compartment, in order to supply compressed gas to said expansion compartment through opening of said switching valve.

7. The fire-extinguishing device according to claim 6, further comprising a pressure control valve for controlled pressurization of said expansion compartment, which is connected to said inlet or to said outlet of said switching valve in order to pressurize said expansion compartment with compressed gas at a reduced, substantially constant extinguishing pressure during said extinguishing process.

8. The fire-extinguishing device according to claim 7, wherein said compressed gas reservoir is designed for a storage pressure of >150 bar, and said fire-extinguishing substance container is designed for an extinguishing pressure of <90 bar.

9. The fire-extinguishing device according to claim 6, wherein said switching valve comprises at least one pneumatic control port, further comprising a temperature-sensitive, pressurized detector line, which is connected to said pneumatic control port of said switching valve in order to open said switching valve in said event of a drop in pressure in said detector line.

10. The fire-extinguishing device according to claim 6, said switching valve having a first and a second pneumatic control port and further comprising a first pressure control valve, and a port for a detector line, said first pressure control valve being connected on said inlet side directly to said compressed gas chamber and on said outlet side to said inlet of said switching valve, said port for said detector line being connected to said first control port and said outlet of said first pressure control valve additionally being connected to said second control port, and said switching valve being connected on said outlet side to said expansion compartment.

11. The fire-extinguishing device according to claim 10, further comprising a second pressure control valve, which is connected on said inlet side to said outlet of said first pressure control valve and on said outlet side to said inlet of said switching valve or on said inlet side to said outlet of said switching valve and on said outlet side to said expansion compartment.

12. The fire-extinguishing device according to claim 11, further comprising a compressed gas cylinder located inside said fire-extinguishing substance container, said compressed gas cylinder comprising said compressed gas chamber and a thickened cylinder bottom, which serves as a fittings block and accommodates at least said switching valve, said first pressure control valve and said second pressure control valve.

13. The fire-extinguishing device according to claim 12, wherein said connecting line, which leads via said switching valve, said first pressure control valve and optionally said second pressure control valve from said compressed gas chamber to said expansion compartment, is formed of bores in said fittings block.

14. The fire-extinguishing device according to claim 10, further comprising a second pressure control valve, which is connected on said inlet side to said first control port and on said outlet side to said port for said detector line.

15. The fire-extinguishing device according to claim 10, further comprising an equalizing line for compensating leaks in said detector line, which equalizing line is connected to said outlet of said first pressure control valve and to said port for said detector line, a non-return valve being arranged in said equalizing line and preventing an excessive loss of propellant via said equalizing line in said event of a significant pressure loss in said detector line.

16. The fire-extinguishing device according to claim 6, further comprising a creeping gas safety device, which is connected to said outlet of said switching valve to prevent a creeping pressure build-up in said expansion compartment.

17. The fire-extinguishing device according to claim 6, further comprising a compressed gas cylinder located inside said fire-extinguishing substance container, said compressed gas cylinder comprising said compressed gas chamber and a thickened cylinder bottom, which serves as a fittings block and accommodates at least said switching valve.

18. The fire-extinguishing device according to claim 17, wherein said connecting line, which leads via said switching valve, said first pressure control valve and optionally said second pressure control valve from said compressed gas chamber to said expansion compartment, is formed of bores in said fittings block.

19. The fire-extinguishing device according to claim 6, further comprising a compressed gas cylinder located inside said fire-extinguishing substance container, said compressed gas cylinder occupying 10% to 35% of said useful volume of said fire-extinguishing substance container.

20. The fire-extinguishing device according to claim 6, wherein said compressed gas reservoir takes a form of a compressed gas cylinder located inside said fire-extinguishing substance container and having an at least partially cylindrical outer wall, and wherein said piston takes a form of an annular piston which is guided displaceably along a cylindrical part of said at least partially cylindrical outer wall of said compressed gas cylinder.

21. The fire-extinguishing device according to claim 20, wherein said piston comprises an inner guide bush for guidance against said cylindrical part of said compressed gas cylinder and an outer guide skirt for guidance against said container shell and wherein said guide bush extends axially less far than said guide skirt.

22. The fire-extinguishing device according to claim 6, further comprising a cylindrical guide shell located inside said fire-extinguishing substance container, said compressed gas reservoir taking a form of a compressed gas cylinder arranged within said cylindrical guide shell, and said piston taking a form of an annular piston guided displaceably along said cylindrical guide shell.

23. The fire-extinguishing device according to claim 22, wherein said piston comprises an inner guide bush for guidance against said guide shell and an outer guide skirt for guidance against said guide shell and wherein said guide bush extends axially less far than said guide skirt.

24. A fire-extinguishing substance container comprising:

a container shell of cylindrical construction and closed at both ends;

a piston axially displaceable in said container shell, which piston separates a fire-extinguishing substance compartment from an expansion compartment in said fire-extinguishing substance container;

a compressed gas reservoir located inside said fire-extinguishing substance container, said reservoir comprising a compressed gas chamber, said compressed gas chamber being separated spatially from said expansion compartment and arranged in said fire-extinguishing substance container coaxially with said container shell, for storing a propellant gas at high storage pressure and for controlled pressurization of said expansion compartment with reduced extinguishing pressure;

wherein said piston is arranged to be displaceable along said compressed gas chamber.

* * * * *

UNITED STATES PATENT AND TRADEMARK OFFICE

CERTIFICATE OF CORRECTION

PATENT NO. : 8,083,003 B2
APPLICATION NO. : 12/159880
DATED : December 27, 2011
INVENTOR(S) : Felten et al.

It is certified that error appears in the above-identified patent and that said Letters Patent is hereby corrected as shown below:

Title Page, Item (22) should read Dec. 28, 2006

Signed and Sealed this
Thirteenth Day of March, 2012

David J. Kappos

David J. Kappos
*Director of the United States Patent and Trademark Office*